US012768576B2

(12) United States Patent
Suemitsu et al.

(10) Patent No.: US 12,768,576 B2
(45) Date of Patent: Oct. 20, 2026

(54) CONDENSER AND TURBO REFRIGERATOR

(71) Applicant: MITSUBISHI HEAVY INDUSTRIES THERMAL SYSTEMS, LTD., Tokyo (JP)

(72) Inventors: Ryosuke Suemitsu, Tokyo (JP); Yusuke Ira, Tokyo (JP); Naoya Miyoshi, Tokyo (JP); Akimasa Yokoyama, Tokyo (JP); Tatsuo Ishiguro, Tokyo (JP); Haruka Nakayama, Tokyo (JP); Atsushi Nakagawa, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 97 days.

(21) Appl. No.: 18/996,829

(22) PCT Filed: Nov. 21, 2022

(86) PCT No.: PCT/JP2022/043036

§ 371 (c)(1),
(2) Date: Jan. 17, 2025

(87) PCT Pub. No.: WO2024/034151

PCT Pub. Date: Feb. 15, 2024

(65) Prior Publication Data

US 2026/0029178 A1 Jan. 29, 2026

(30) Foreign Application Priority Data

Aug. 10, 2022 (JP) ..... 2022-128389

(51) Int. Cl.
*F25B 39/04* (2006.01)
*F25B 1/053* (2006.01)

(52) U.S. Cl.
CPC ..... *F25B 39/04* (2013.01); *F25B 1/053* (2013.01)

(58) Field of Classification Search
CPC ..... F25B 39/04; F25B 1/053
See application file for complete search history.

(56) References Cited

U.S. PATENT DOCUMENTS 5,881,564 A 3/1999 Kishimoto et al.

FOREIGN PATENT DOCUMENTS

JP 10-131889 A 5/1998

OTHER PUBLICATIONS

International Search Report and Written Opinion of the International Searching Authority for International Application No. PCT/JP2022/043036, dated Jan. 31, 2023, with English translation.

*Primary Examiner* — Nael N Babaa
(74) *Attorney, Agent, or Firm* — Birch, Stewart, Kolasch & Birch, LLP

(57) ABSTRACT

This condenser comprises: an introduction part having a suction port for suctioning a gas coolant emitted from a compressor, and a gas baffle plate through which the suctioned gas coolant can pass; a shell capable of housing the gas coolant that has passed through the gas baffle plate; and a check valve capable of opening and closing the suction port. The check valve has a valve body that overlaps the gas baffle plate when in an open state and covers the suction hole when in a closed state.

5 Claims, 4 Drawing Sheets

CONDENSER AND TURBO REFRIGERATOR

TECHNICAL FIELD

The present disclosure relates to a condenser and a turbo refrigerator.

The present application claims priority to Japanese Patent Application No. 2022-128389, filed in Japan on Aug. 10, 2022, the content of which is incorporated herein by reference.

BACKGROUND ART

PTL 1 discloses a turbo refrigerator. The turbo refrigerator includes a refrigerating cycle consisting of an evaporator, a compressor, and a condenser. In a case where the turbo refrigerator is driven, a refrigerant flows from the evaporator to the compressor and from the compressor to the condenser in the refrigerating cycle. However, when the turbo refrigerator is stopped due to a power failure or the like, there is a concern that the refrigerant may flow backward from the condenser to the compressor due to a differential pressure between the evaporator and the condenser. In order to prevent the refrigerant from flowing backward, a check valve is provided in a line connecting the compressor and the condenser.

CITATION LIST

Patent Literature

[PTL 1] Japanese Unexamined Patent Application Publication No. 10-131889

SUMMARY OF INVENTION

Technical Problem

However, in the turbo refrigerator disclosed in PTL 1, there is a problem in that the turbo refrigerator is increased in size since a space for installing the check valve between the compressor and the condenser is required.

The present disclosure has been made to solve the above-described problems, and an object of the present disclosure is to provide a condenser and a turbo refrigerator that can achieve reduction in size.

Solution to Problem

In order to solve the above-described problems, a condenser according to the present disclosure includes an introduction unit including a suction port for suctioning a gas refrigerant discharged from a compressor and a gas baffle plate through which the suctioned gas refrigerant is configured to pass, a shell configured to accommodate the gas refrigerant that has passed through the gas baffle plate, and a check valve configured to open and close the suction port, in which the check valve includes a valve body that overlaps the gas baffle plate in an open state and covers the suction port in a closed state.

The turbo refrigerator according to the present disclosure includes the above-described condenser.

Advantageous Effects of Invention

According to the condenser and the turbo refrigerator of the present disclosure, it is possible to achieve reduction in size.

DESCRIPTION OF EMBODIMENTS (Turbo Refrigerator)

Hereinafter, a turbo refrigerator 1 including a condenser 20 according to an embodiment of the present disclosure will be described with reference to FIGS. 1 to 4.

Figure 1:
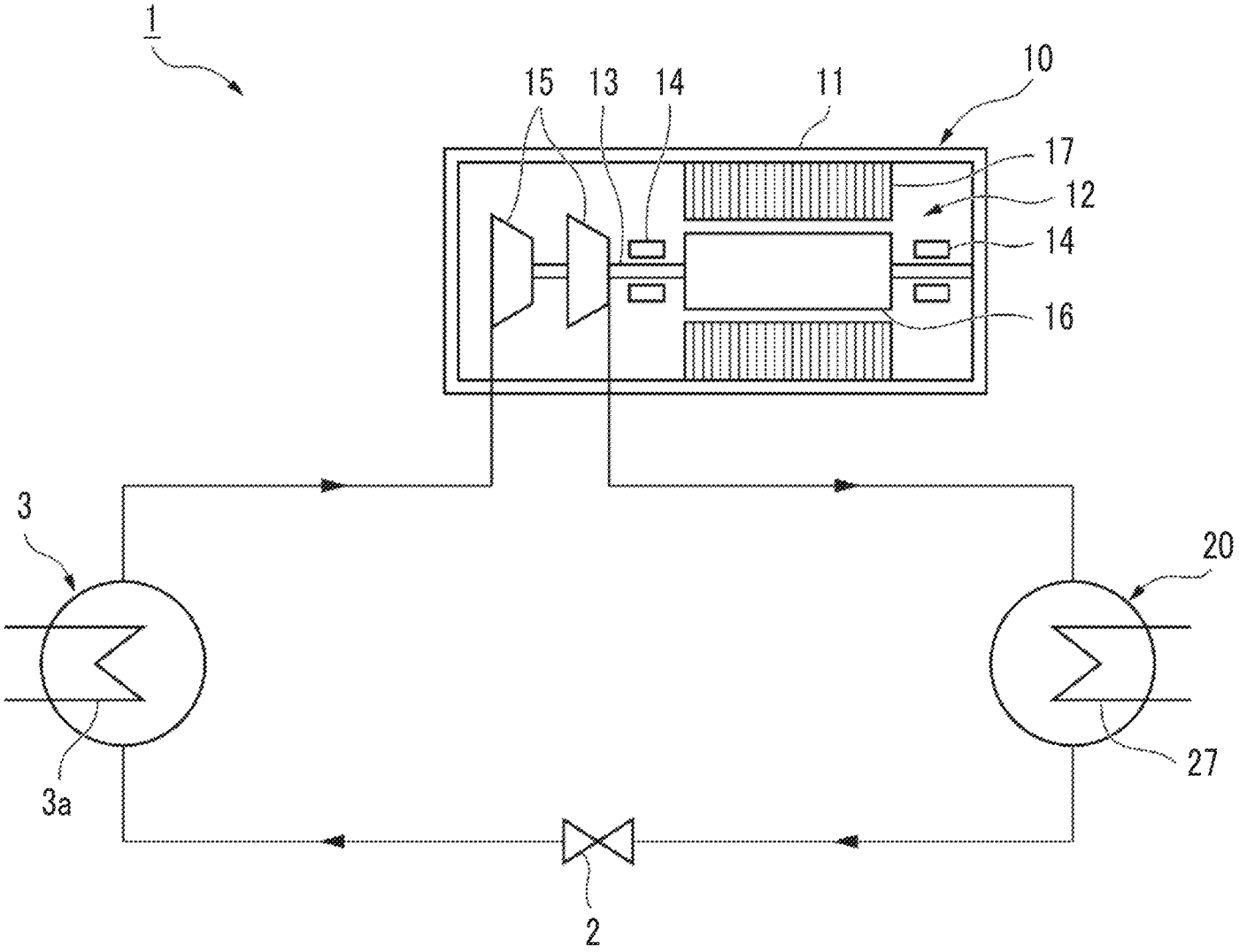
FIG. 1 is a diagram showing an overall configuration of a turbo refrigerator according to an embodiment of the present disclosure.

As shown in FIG. 1, the turbo refrigerator 1 includes a compressor 10, the condenser 20, an expansion valve 2, and an evaporator 3.

(Compressor)

The compressor 10 is a turbo compressor that compresses a gas refrigerant. The compressor 10 includes a casing 11, a motor 12, a shaft 13, a bearing 14, and an impeller 15. The casing 11 accommodates the motor 12, the shaft 13, the bearing 14, and the impeller 15. The motor 12 includes a rotor 16 that rotates about a central axis, and a cylindrical stator 17 that is provided around the rotor 16 with a predetermined gap. The shaft 13 is connected to the rotor 16, and a rotation output of the rotor 16 is transmitted to the shaft 13. The shaft 13 is rotatably supported by the bearing 14. The impeller 15 is provided on the shaft 13, and the rotation output of the rotor 16 is transmitted to the impeller 15 through the shaft 13. In the present embodiment, the impeller 15 is provided in two stages in parallel with the axial direction of the shaft 13.

(Condenser)

The condenser 20 condenses the high-temperature and high-pressure gas refrigerant compressed by the compressor 10. The condenser 20 is provided with a first heat transfer pipe 27 through which cooling water for cooling the refrigerant flows. The cooling water is discharged to the outside by a cooling tower (not shown) and then guided to the condenser 20 again.

(Expansion Valve)

The expansion valve 2 expands a liquid refrigerant guided from the condenser 20.

(Evaporator)

The evaporator 3 evaporates the liquid refrigerant expanded by the expansion valve 2. The evaporator 3 is provided with a second heat transfer pipe 3*a* for cooling the cold water supplied to the external load. The gas refrigerant generated in the evaporator 3 is guided to the compressor 10 again.

(Structure of Condenser)

Subsequently, the structure of the condenser 20 will be described.

Figure 2:
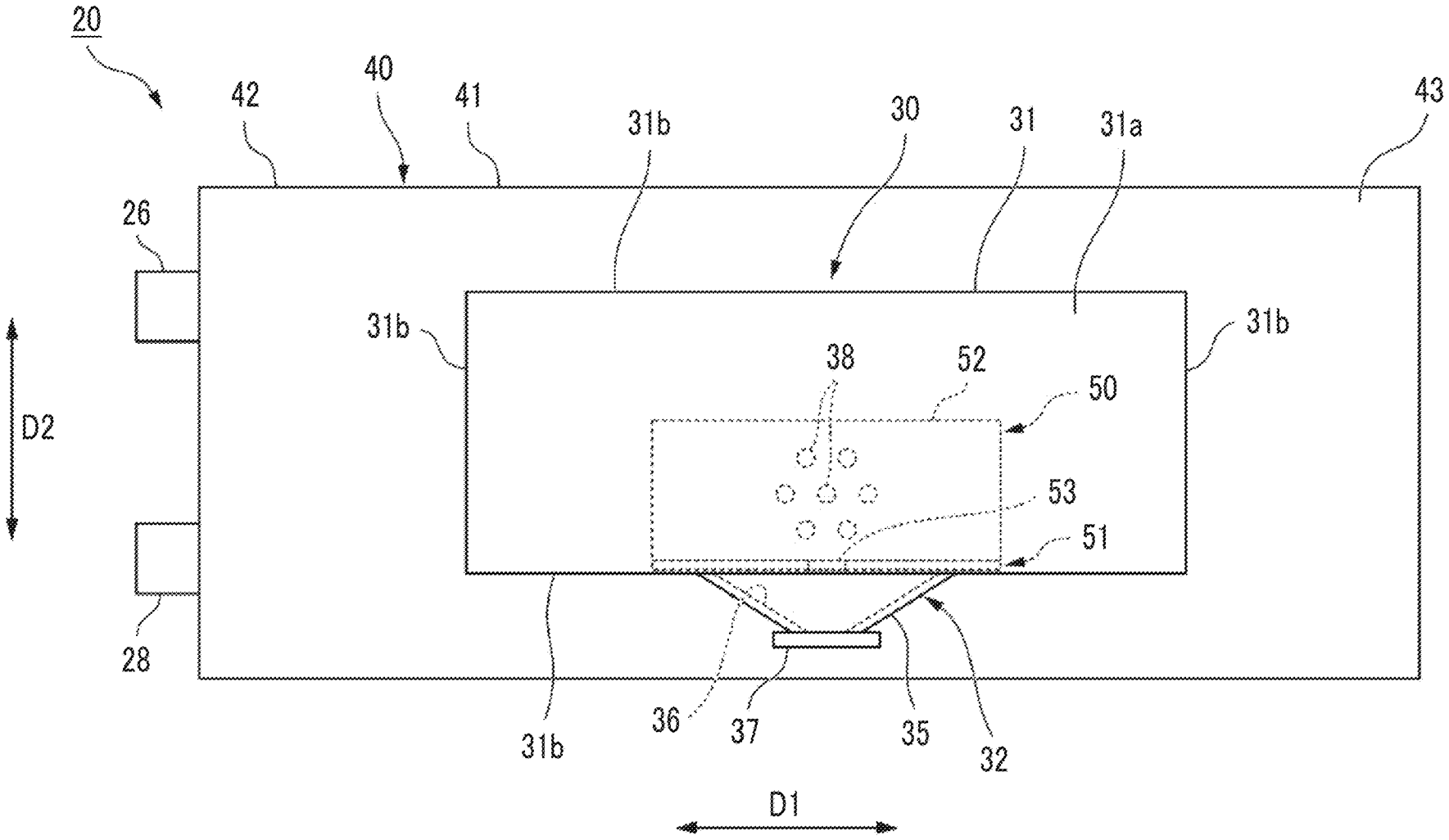
FIG. 2 is a plan view of a condenser according to the embodiment of the present disclosure when viewed from above.
Figure 3:
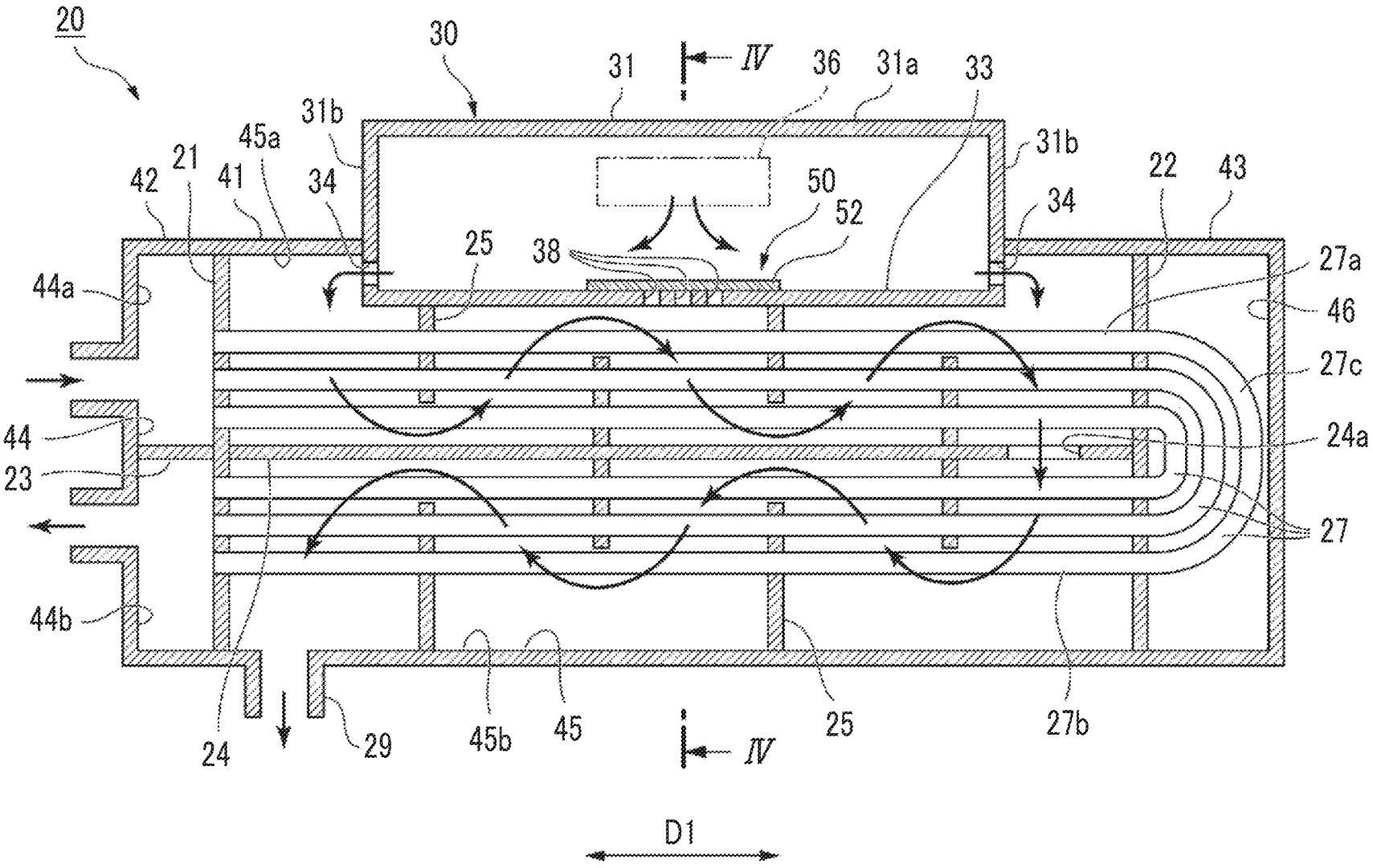
FIG. 3 is a cross-sectional view of the condenser according to the embodiment of the present disclosure when viewed from a second direction.
Figure 4:
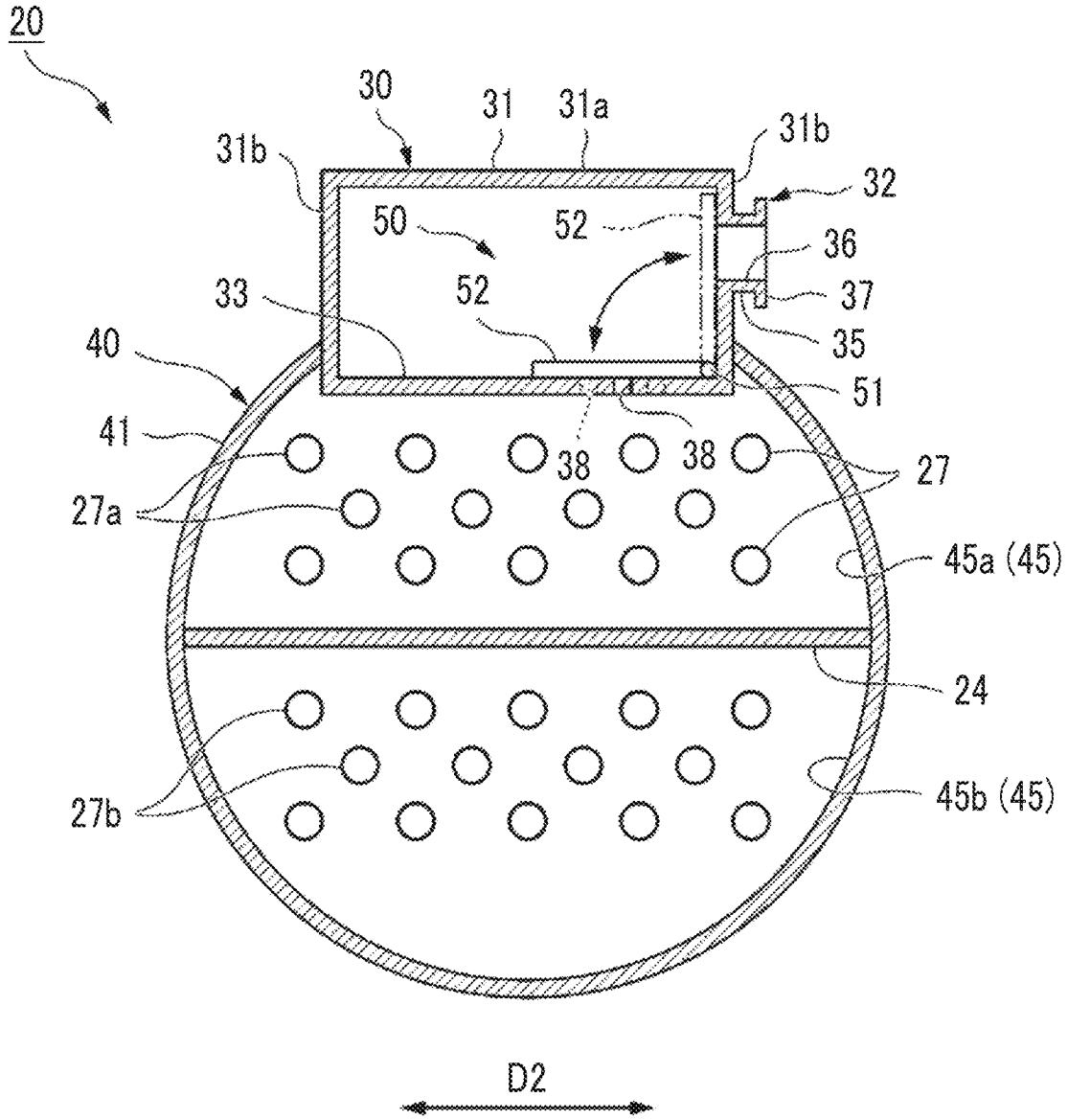
FIG. 4 is a cross-sectional view taken along line IV-IV of FIG. 3.

As shown in FIGS. 2 to 4, the condenser 20 includes an introduction unit 30, a shell 40, a first partition plate 21, a second partition plate 22, a third partition plate 23, a fourth partition plate 24, an internal baffle plate 25, a cooling water introduction pipe 26, a first heat transfer pipe 27, a cooling water discharge pipe 28, a discharge unit 29, and a check valve 50.

(Introduction Unit)

The introduction unit 30 suctions the high-pressure gas refrigerant supplied from the compressor 10. The introduction unit 30 includes an introduction unit main body 31, a suction unit 32, and a gas baffle plate 33.

(Introduction Unit Main Body)

The introduction unit main body 31 is a box-shaped container that is formed in a rectangular plate shape extending in one direction and is open downward.

In the following, the extension direction of the introduction unit main body 31 will be referred to as a "first direction D1", and a horizontal direction and a direction orthogonal to the first direction D1 will be referred to as a "second direction D2".

An upper wall 31*a* of the introduction unit main body 31 extends in the horizontal direction, and a side wall 31*b* of the introduction unit main body 31 extends in a vertical plane. The high-pressure gas refrigerant discharged from the compressor 10 flows in the introduction unit main body 31.

In addition, the two side walls 31*b* located on both sides of the side walls 31*b* of the introduction unit main body 31 in the first direction D1 are formed with the communication hole 34.

(Suction Unit)

The suction unit 32 is provided in a central portion of the introduction unit main body 31 in the first direction D1. The introduction unit main body 31 and the suction unit 32 are connected to each other, for example, by welding. The suction unit 32 includes a suction unit main body 35 that protrudes from the side wall 31*b* of the introduction unit main body 31 in the second direction D2, a suction port 36 that penetrates the suction unit main body 35 in the second direction D2, and a flange 37 that is provided on an outer surface of the suction unit main body 35.

(Suction Unit Main Body)

The suction unit main body 35 is formed in a trapezoidal shape that tapers toward the side away from the introduction unit main body 31 when viewed from the up-down direction.

(Suction Port)

The suction port 36 communicates the suction unit main body 35 with the introduction unit 30 to suction the gas refrigerant discharged from the compressor 10. The suction port 36 is formed along the outer surface of the suction unit main body 35 and is formed in a trapezoidal shape that tapers toward the side away from the introduction unit main body 31 when viewed from the up-down direction. On the other hand, the suction port 36 is formed in a rectangular shape when viewed from the second direction D2. The end portion of the suction port 36 on the side of the introduction unit main body 31 is formed in a rectangular shape extending in the first direction D1 when viewed from the second direction D2.

(Flange)

The flange 37 is provided on an end portion of the tapered side of the suction unit main body 35 on a side opposite to the introduction unit main body 31. The flange 37 is provided over the entire circumference of the suction port 36 and protrudes outward from the outer surface of the suction unit main body 35.

(Gas Baffle Plate)

The gas baffle plate 33 is a plate member that closes the opening of the introduction unit main body 31 on a lower side. The gas baffle plate 33 extends in the horizontal direction. The gas baffle plate 33 allows the gas refrigerant suctioned by the introduction unit 30 to pass therethrough. A through-hole 38 that penetrates the gas baffle plate 33 is provided in the gas baffle plate 33. In the present embodiment, a plurality of the through-holes 38 are provided in an intermediate portion of the gas baffle plate 33 in the first direction D1. In the present embodiment, all of the plurality of through-holes 38 are provided in the same circular shape. In addition, six through-holes 38 are provided in a hexagonal shape so as to surround one through-hole 38.

The lower portion of the introduction unit 30 including the gas baffle plate 33 is covered from below by the shell 40.

(Shell)

The shell 40 is a container capable of accommodating the gas refrigerant that has passed through the gas baffle plate 33. The outer shape of the shell 40 is formed in a columnar shape. The shell 40 includes a body portion 41, a first end portion 42, and a second end portion 43.

The body portion 41 is formed in a cylindrical shape extending in the first direction D1. The body portion 41 is provided such that the lower portion of the introduction unit 30 including the gas baffle plate 33 and the communication hole 34 is embedded. The body portion 41 communicates with the introduction unit 30 through the communication hole 34 and the through-hole 38. The body portion 41 and the introduction unit 30 are bonded to each other by, for example, welding. The first end portion 42 is provided at an end portion of the body portion 41 on one side in the first direction D1 and covers the body portion 41 on the one side in the first direction D1. The second end portion 43 is provided at an end portion of the body portion 41 on the other side in the first direction D1 and covers the body portion 41 on the other side in the first direction D1.

(First Partition Plate and Second Partition Plate)

The first partition plate 21 is provided at a boundary between the body portion 41 and the first end portion 42 of the shell 40. The second partition plate 22 is provided at a boundary between the body portion 41 and the second end portion 43 of the shell 40. The first partition plate 21 and the second partition plate 22 partition the inside of the shell 40 into three chambers, that is, a first chamber 44, a second chamber 45, and a third chamber 46, in order from the one side in the first direction D1.

(Third Partition Plate)

The third partition plate 23 is provided in the first chamber 44 of the shell 40. The third partition plate 23 partitions the first chamber 44 into two chambers, that is, an entrance chamber 44*a* and an exit chamber 44*b*. In the present embodiment, the entrance chamber 44*a* is located above the exit chamber 44*b*.

(Fourth Partition Plate)

The fourth partition plate 24 is provided in the second chamber 45 of the shell 40. The fourth partition plate 24 partitions the third chamber 46 into two chambers, that is, a first straight pipe chamber 45*a* and a second straight pipe chamber 45*b*. In the present embodiment, the fourth partition plate 24 is provided at the same position as the third partition plate 23 in the up-down direction, and the first straight pipe chamber 45*a* is located above the second straight pipe chamber 45*b*.

The first straight pipe chamber 45*a* communicates with the inside of the introduction unit 30 through the communication hole 34.

In addition, an internal communication hole 24*a* is formed in the end portion of the fourth partition plate 24 on the other side in the first direction D1. The internal communication hole 24*a* communicates the first straight pipe chamber 45*a* with the second straight pipe chamber 45*b*. Therefore, the gas refrigerant introduced into the introduction unit 30 flows to be guided in the order of the first straight pipe chamber 45*a* and the second straight pipe chamber 45*b*.

(Internal Baffle Plate)

A plurality of the internal baffle plates 25 are provided in each of the first straight pipe chamber 45*a* and the second straight pipe chamber 45*b*. The plurality of internal baffle plates 25 are provided in parallel with the first direction D1. The internal baffle plates 25 are alternately disposed in each of the first straight pipe chamber 45*a* and the second straight pipe chamber 45*b* in the up-down direction. The gas refrigerant flows while meandering through the internal baffle plate 25. The internal baffle plate 25 is provided with a fine hole (not shown), and the refrigerant (a gas refrigerant and a liquid refrigerant generated by condensation) can flow through the second chamber 45 through the hole (not shown).

In addition, at least some of the internal baffle plates 25 in the first straight pipe chamber 45*a* are bonded to the gas baffle plate 33 and are thermally connected to the gas baffle plate 33.

(Cooling Water Introduction Pipe)

The cooling water introduction pipe 26 is provided on an outer surface of the first end portion 42 of the shell 40. The cooling water introduction pipe 26 communicates with the entrance chamber 44*a* in the shell 40. The cooling water introduction pipe 26 guides cooling water into the entrance chamber 44*a* from the cooling tower (not shown).

(First Heat Transfer Pipe)

A plurality of the first heat transfer pipes 27 are provided in the second chamber 45 and the third chamber 46 in the shell 40. The first heat transfer pipe 27 includes a first straight pipe 27*a*, a second straight pipe 27*b*, and a curved pipe 27*c*.

The first straight pipe 27*a* is provided in the first straight pipe chamber 45*a*. The first straight pipe 27*a* extends in the first direction D1 and connects the first partition plate 21 and the second partition plate 22. The first straight pipe 27*a* penetrates the internal baffle plate 25 in the first straight pipe chamber 45*a* in the first direction D1. The second straight pipe 27*b* is provided in the second straight pipe chamber 45*b*. The second straight pipe 27*b* extends in the first direction D1 and connects the first partition plate 21 and the second partition plate 22. The second straight pipe 27*b* penetrates the internal baffle plate 25 in the second straight pipe chamber 45*b* in the first direction D1. The curved pipe 27*c* is provided in the third chamber 46. The curved pipe 27*c* is formed in a U shape when viewed from the second direction D2. An end portion of the curved pipe 27*c* on the upper side is connected to the first straight pipe 27*a*, and an end portion of the curved pipe 27*c* on the lower side is connected to the second straight pipe 27*b*. The curved pipe 27*c* communicates with the first straight pipe 27*a* and the second straight pipe 27*b*.

The cooling water guided to the entrance chamber 44*a* flows into the first heat transfer pipe 27. The cooling water flows through the first heat transfer pipe 27 in the order of the first straight pipe 27*a*, the curved pipe 27*c*, and the second straight pipe 27*b*, and is guided to the exit chamber 44*b*. The cooling water performs heat exchange with the gas refrigerant in the second chamber 45 in a process of flowing through the first heat transfer pipe 27. As a result, the gas refrigerant is cooled and condensed into the liquid refrigerant. The liquid refrigerant is temporarily stored in the second straight pipe chamber 45*b*. On the other hand, the cooling water is heated by receiving heat of the gas refrigerant.

(Cooling Water Discharge Pipe)

The cooling water discharge pipe 28 is provided on the outer surface of the first end portion 42 of the shell 40. The cooling water discharge pipe 28 communicates with the exit chamber 44*b* in the shell 40. The cooling water discharge pipe 28 guides the cooling water that has passed through the first heat transfer pipe 27 to the cooling tower (not shown). The cooling water that has returned from the cooling water discharge pipe 28 to the cooling tower is cooled in the cooling tower and is guided to the entrance chamber 44*a* again.

(Discharge Unit)

The discharge unit 29 is provided in the body portion 41 of the shell 40. The discharge unit 29 is provided on the outer peripheral surface of the body portion 41 and is formed in a tubular shape that communicates with the second straight pipe chamber 45*b*. The discharge unit 29 guides the liquid refrigerant stored in the second straight pipe chamber 45*b* to the expansion valve 2. When the liquid refrigerant is expanded in the expansion valve 2, the liquid refrigerant is guided to the evaporator 3 and is vaporized again into the gas refrigerant. The gas refrigerant generated in the evaporator 3 is compressed by the compressor 10 and is guided to the condenser 20 again.

As described above, in the turbo refrigerator 1, the refrigerant circulates through the cycle of the compressor 10, the condenser 20, the expansion valve 2, and the evaporator 3. However, for example, when the turbo refrigerator 1 is suddenly stopped due to a power failure or the like, the refrigerant may flow backward from the condenser 20 to the compressor 10 due to a differential pressure between the condenser 20 and the evaporator 3. In order to prevent this backward flow, the check valve 50 is provided inside the introduction unit 30.

In the following, a flow of the refrigerant in the order of the compressor 10, the condenser 20, the expansion valve 2, and the evaporator 3 is referred to as a forward flow, and a flow in the opposite direction is referred to as a backward flow.

(Check Valve)

The check valve 50 is provided inside the introduction unit main body 31. The check valve 50 is provided to be capable of opening and closing the suction port 36. The check valve 50 includes a hinge 51, a valve body 52, and a spring 53.

(Hinge)

The hinge 51 is provided on an edge portion of the gas baffle plate 33 connected to the side wall 31*b* provided with the suction unit 32. The hinge 51 extends in the first direction D1.

(Valve Body)

The valve body 52 is rotatable about a central axis of the hinge 51 extending in the first direction D1 by the hinge 51. The check valve 50 opens and closes the suction port 36 by the rotation of the valve body 52 around the hinge 51. The valve body 52 is installed to overlap a region where the through-hole 38 of the gas baffle plate 33 is formed in the open state, and to cover the suction port 36 in the closed state.

In addition, in a case where the check valve 50 is in the open state, the valve body 52 is located outside the suction port 36 when viewed from a forward flow direction of the gas refrigerant suctioned from the compressor 10 to the suction port 36. Accordingly, in a case where the check valve 50 is in the open state, the suction port 36 is fully opened.

In addition, in the present embodiment, the valve body 52 described above is formed in a rectangular plate shape extending in the first direction D1.

(Spring)

The spring 53 generates an elastic force in a direction of overlapping the valve body 52 on the gas baffle plate 33. The spring 53 of the present embodiment is a so-called a hinge spring used on the outer peripheral surface of the hinge 51. The spring constant of the spring 53 is set to a magnitude at which the elastic force is canceled by the backward flow of the gas refrigerant discharged from the suction port 36 to the compressor 10.

(Function of Check Valve)

Subsequently, the function of the check valve 50 will be described.

When the turbo refrigerator 1 is operated normally, the refrigerant flows through the cycle of the turbo refrigerator 1 in the order of the compressor 10, the condenser 20, the expansion valve 2, and the evaporator 3. In this case, the valve body 52 of the check valve 50 is maintained in a state of being overlapped on the gas baffle plate 33 by the gravity and the elastic force of the spring 53. Therefore, the suction port 36 is completely opened, and conversely, the through-hole 38 is completely closed by the valve body 52. Accordingly, the gas refrigerant discharged from the compressor 10 is smoothly suctioned into the introduction unit 30 from the suction port 36, flows through the gas baffle plate 33 without flowing into the shell 40 from the through-hole 38, and is guided into the shell 40 through the communication hole 34.

On the other hand, for example, when the turbo refrigerator 1 is suddenly stopped due to a power failure or the like, the condenser 20 may be in a state of higher pressure than the evaporator 3, and the evaporator 3 may communicate with the compressor 10 through the condenser 20 and the compressor 10. In this case, the refrigerant tries to flow backward from the condenser 20 to the compressor 10 due to the differential pressure between the condenser 20 and the evaporator 3. However, in the present embodiment, the dynamic pressure of the refrigerant that tries to flow backward from the condenser 20 to the compressor 10 is applied to the valve body 52 through the through-hole 38. Due to this dynamic pressure, the valve body 52 is immediately pushed up to close the suction port 36 and to prevent the refrigerant from flowing backward.

As described above, the check valve 50 allows the refrigerant to flow in the forward direction during the normal operation of the turbo refrigerator 1, and immediately prevents the backward flow that may occur due to the differential pressure between the condenser 20 and the evaporator 3 during the emergency stop of the turbo refrigerator 1.

Actions and Effects

The condenser 20 and the turbo refrigerator 1 according to the present embodiment can exert the following actions and effects.

In the present embodiment, the condenser 20 includes the introduction unit 30 that has a suction port 36 for suctioning the gas refrigerant discharged from the compressor 10 and the gas baffle plate 33 through which the suctioned gas refrigerant can pass, a shell 40 that can accommodate the gas refrigerant that has passed through the gas baffle plate 33, and the check valve 50 that can open and close the suction port 36. The check valve 50 includes the valve body 52 that overlaps the gas baffle plate 33 in the open state and covers the suction port 36 in the closed state.

In the present embodiment, the check valve 50 can open the suction port 36 by overlapping the valve body 52 and the gas baffle plate 33 each other during the forward flow when the gas refrigerant is suctioned from the compressor 10 to the suction port 36, and can close the suction port 36 by covering the suction port 36 with the valve body 52 during the backward flow when the gas refrigerant is discharged from the suction port 36 to the compressor 10. Additionally, the check valve 50 is provided in the condenser 20. Therefore, the condenser 20 can prevent the backward flow of the gas refrigerant by the function of the condenser 20 itself. Therefore, since it is not necessary to provide a device for preventing the refrigerant from flowing backward to the outside of the condenser 20, it is possible to achieve reduction in size of the condenser 20. That is, since it is possible to achieve reduction in size of the turbo refrigerator 1, it is possible to reduce the ground contact area of the turbo refrigerator 1.

In addition, when the refrigerant flows backward from the condenser 20 to the compressor 10, the shaft 13 of the compressor 10 is reversed and an excessive load is applied to the bearing 14. Although this may be a factor that damages the bearing 14, in the present embodiment, since the check valve 50 can prevent the refrigerant from flowing backward, the damage to the bearing 14 due to the backward flow can be prevented.

In the present embodiment, in a case where the check valve 50 is in the open state, the valve body 52 is located outside the suction port 36 when viewed from a forward flow direction of the gas refrigerant suctioned from the compressor 10 to the suction port 36.

Accordingly, the check valve 50 can fully open the suction port 36 during the forward flow of the gas refrigerant. The condenser 20 can smoothly recover the gas refrigerant discharged from the compressor 10. Accordingly, since the refrigerant can smoothly flow through the condenser 20, the heat exchange efficiency of the condenser 20 is improved. In addition, since the forward flow of the gas refrigerant is not obstructed by the valve body 52, an increase in pressure loss can be suppressed, and it is possible to increase the coefficient of performance (COP) of the condenser 20. That is, it is possible to increase the COP of the turbo refrigerator 1.

In the present embodiment, the through-hole 38 formed in the gas baffle plate 33 in a region overlapping the valve body 52 in a case where the check valve 50 is in the open state.

Accordingly, the valve body 52 is moved by the dynamic pressure due to the backward flow of the gas refrigerant discharged to the compressor 10 from the suction port 36. Accordingly, in a case where the backward flow of the gas refrigerant occurs, the suction port 36 is quickly covered by the valve body 52. Therefore, it is possible to quickly prevent the backward flow of the gas refrigerant while making the configuration of the check valve 50 simple.

In the present embodiment, the check valve 50 includes the spring 53 that generates an elastic force in a direction of overlapping the valve body 52 on the gas baffle plate 33. The spring constant of the spring 53 is a magnitude at which the elastic force is canceled by the backward flow of the gas refrigerant discharged from the suction port 36 to the compressor 10.

Accordingly, during the forward flow of the gas refrigerant, since the check valve 50 is maintained in the open state by the elastic force of the spring 53, the gas refrigerant discharged from the compressor 10 is smoothly recovered in the condenser 20. On the other hand, in a case where the backward flow of the gas refrigerant occurs, since the elastic force of the spring 53 is canceled by the dynamic pressure of the backward flow and the check valve 50 is in the closed state, the backward flow of the gas refrigerant is quickly prevented. For example, by setting the spring constant of the spring 53 to an appropriate value, the valve body 52 can be maintained in the open state in the backward flow of a degree that the damage to the bearing 14 does not occur, and the valve body 52 can be set to the closed state in the backward flow of a degree equal to or more than the minimum flow rate at which the damage to the bearing 14 may occur.

Other Embodiments

Although the embodiments of the present disclosure have been described in detail with reference to the drawings, the specific configuration is not limited to the embodiments and includes, for example, an amendment to a design that falls within the scope that does not depart from the gist of the present disclosure.

In the above-described embodiment, the case where the condenser 20 includes the internal baffle plate 25 has been described, but the present disclosure is not limited thereto, and the condenser 20 may not include the internal baffle plate 25.

In the above-described embodiment, the gas baffle plate 33 is provided with the plurality of through-holes 38, but the present disclosure is not limited thereto. The size, the shape, and the number of the through-holes 38 can be appropriately changed.

In the above-described embodiment, the check valve 50 includes the spring 53 that applies the elastic force to the valve body 52. However, the present disclosure is not limited thereto, and the check valve 50 may not include the spring 53. In a case where the spring 53 is not provided, the number of components is reduced, and the probability that the check valve 50 is damaged is reduced.

Additional Notes

The condenser 20 and the turbo refrigerator 1 described in the embodiment are understood as follows, for example.

(1) A condenser 20 according to a first aspect includes an introduction unit 30 including a suction port 36 for suctioning a gas refrigerant discharged from a compressor 10 and a gas baffle plate 33 through which the suctioned gas refrigerant is configured to pass, a shell 40 configured to accommodate the gas refrigerant that has passed through the gas baffle plate 33, and a check valve 50 configured to open and close the suction port 36, in which the check valve 50 includes a valve body 52 that overlaps the gas baffle plate 33 in an open state and covers the suction port 36 in a closed state.

In the present aspect, the check valve 50 can open the suction port 36 by overlapping the valve body 52 and the gas baffle plate 33 each other during the forward flow when the gas refrigerant is suctioned from the compressor 10 to the suction port 36, and can close the suction port 36 by covering the suction port 36 with the valve body 52 during the backward flow when the gas refrigerant is discharged from the suction port 36 to the compressor 10. Additionally, the check valve 50 is provided in the condenser 20. Therefore, the condenser 20 can prevent the backward flow of the gas refrigerant by the function of the condenser 20 itself.

(2) The condenser 20 according to a second aspect is the condenser 20 according to the first aspect, in which the valve body 52 may be located outside the suction port 36 when viewed from a forward flow direction of the gas refrigerant suctioned from the compressor 10 to the suction port 36 in a case where the check valve 50 is in the open state.

Accordingly, the check valve 50 can fully open the suction port 36 during the forward flow of the gas refrigerant. The condenser 20 can smoothly recover the gas refrigerant discharged from the compressor 10.

(3) The condenser 20 according to a third aspect is the condenser 20 according to the first or second aspect, in which a through-hole 38 may be formed in the gas baffle plate 33 in a region overlapping the valve body 52 in a case where the check valve 50 is in the open state.

Accordingly, the valve body 52 is moved by the dynamic pressure due to the backward flow of the gas refrigerant discharged to the compressor 10 from the suction port 36. Accordingly, in a case where the backward flow of the gas refrigerant occurs, the suction port 36 is quickly covered by the valve body 52.

(4) The condenser 20 according to a fourth aspect is the condenser 20 according to any one of the first to third aspects, in which the check valve 50 may include a spring 53 that generates an elastic force in a direction of overlapping the valve body 52 on the gas baffle plate 33, and a spring constant of the spring 53 may be a magnitude at which the elastic force is canceled by a backward flow of the gas refrigerant discharged from the suction port 36 to the compressor 10.

Accordingly, during the forward flow of the gas refrigerant, since the check valve 50 is maintained in the open state by the elastic force of the spring 53, the gas refrigerant discharged from the compressor 10 is smoothly recovered in the condenser 20. On the other hand, in a case where the backward flow of the gas refrigerant occurs, since the elastic force of the spring 53 is canceled by the dynamic pressure of the backward flow and the check valve 50 is in the closed state, the backward flow of the gas refrigerant is quickly prevented.

(5) A turbo refrigerator 1 according to a fifth aspect includes the condenser 20 according to any one of the first to fourth aspects.

INDUSTRIAL APPLICABILITY

According to the condenser and the turbo refrigerator of the present disclosure, it is possible to achieve reduction in size.

REFERENCE SIGNS LIST

1: turbo refrigerator
2: expansion valve
3: evaporator
**3*a***: second heat transfer pipe
10: compressor
11: casing
12: motor
13: shaft
14: bearing
15: impeller
16: rotor
17: stator
20: condenser
21: first partition plate
22: second partition plate

23: third partition plate
24: fourth partition plate
24*a*: internal communication hole
25: internal baffle plate
26: cooling water introduction pipe
27: first heat transfer pipe
27*a*: first straight pipe
27*b*: second straight pipe
27*c*: curved pipe
28: cooling water discharge pipe
29: discharge unit
30: introduction unit
31: introduction unit main body
31*a*: upper wall
31*b*: side wall
32: suction unit
33: gas baffle plate
34: communication hole
35: suction unit main body
36: suction port
37: flange
38: through-hole
40: shell
41: body portion
42: first end portion
43: second end portion
44: first chamber
44*a*: entrance chamber
44*b*: exit chamber
45: second chamber
45*a*: first straight pipe chamber
45*b*: second straight pipe chamber
46: third chamber
50: check valve
51: hinge
52: valve body
53: spring D1: first direction
D2: second direction

The invention claimed is:

1. A condenser comprising:

an introduction unit including a suction port for suctioning a gas refrigerant discharged from a compressor and a gas baffle plate through which the suctioned gas refrigerant is configured to pass;

a shell configured to accommodate the gas refrigerant that has passed through the gas baffle plate; and a check valve configured to open and close the suction port, wherein the check valve includes a valve body that overlaps the gas baffle plate in an open state and covers the suction port in a closed state.

2. The condenser according to claim 1, wherein the valve body is located outside the suction port when viewed from a forward flow direction of the gas refrigerant suctioned from the compressor to the suction port in a case where the check valve is in the open state.

3. The condenser according to claim 1, wherein a through-hole is formed in the gas baffle plate in a region overlapping the valve body in a case where the check valve is in the open state.

4. The condenser according to claim 1, wherein the check valve includes a spring that generates an elastic force in a direction of overlapping the valve body on the gas baffle plate, and a spring constant of the spring is a magnitude at which the elastic force is canceled by a backward flow of the gas refrigerant discharged from the suction port to the compressor.

5. A turbo refrigerator comprising: the condenser according to claim 1.

* * * * *